US011002232B2

(12) United States Patent
Ikeda

(10) Patent No.: US 11,002,232 B2
(45) Date of Patent: May 11, 2021

(54) V-ENGINE AIR INTAKE STRUCTURE

(71) Applicant: SUZUKI MOTOR CORPORATION, Hamamatsu (JP)

(72) Inventor: Kentaro Ikeda, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 16/582,590

(22) Filed: Sep. 25, 2019

(65) Prior Publication Data

US 2020/0102919 A1 Apr. 2, 2020

(30) Foreign Application Priority Data

Sep. 28, 2018 (JP) ..... JP2018-184408

(51) Int. Cl.

| | |
|---|---|
| ***F02M 35/116*** | (2006.01) |
| ***F02B 75/22*** | (2006.01) |
| ***F02M 35/10*** | (2006.01) |
| ***F02M 35/104*** | (2006.01) |
| ***F02B 27/02*** | (2006.01) |

(52) U.S. Cl.

CPC ..... *F02M 35/116* (2013.01); *F02B 27/02* (2013.01); *F02B 75/22* (2013.01); *F02M 35/10* (2013.01); *F02M 35/104* (2013.01); *F02M 35/1015* (2013.01)

(58) Field of Classification Search

CPC .... F02M 35/116; F02M 35/10; F02M 35/015; F02M 35/104; F02B 75/22; F02B 27/02

See application file for complete search history.

(56) References Cited

U.S. PATENT DOCUMENTS

| | | | | |
|---|---|---|---|---|
| 5,048,471 | A * | 9/1991 | Takii | F02B 27/0252 123/184.36 |
| 6,205,986 | B1 | 3/2001 | Nojima et al. | |
| 7,252,064 | B2 * | 8/2007 | Koenneker | F02B 27/0284 123/184.55 |
| 2002/0170519 | A1 * | 11/2002 | Miyashita | F02M 35/167 123/184.55 |
| 2008/0190683 | A1 * | 8/2008 | Hoeve | B60K 13/06 180/229 |
| 2014/0109869 | A1 | 4/2014 | Takahashi et al. | |

FOREIGN PATENT DOCUMENTS

| | | | |
|---|---|---|---|
| EP | 1 630 382 | A1 | 3/2006 |
| JP | 2000-179407 | A | 6/2000 |
| JP | 2006-62413 | A | 3/2006 |
| JP | 2009-275514 | A | 11/2009 |
| JP | 2014-84796 | A | 5/2014 |

* cited by examiner

*Primary Examiner* — Syed O Hasan

(74) *Attorney, Agent, or Firm* — Troutman Pepper Hamilton Sanders LLP

(57) ABSTRACT

A first throttle body and a second throttle body include valve rotation devices that independently drive respective throttle valves. The first throttle body and the second throttle body are arranged such that the respective valve rotation devices have states rotated around respective bore central axes to cause respective throttle valve rotation shafts to have angles with respect to straight lines parallel to a crankshaft in an engine top view.

7 Claims, 5 Drawing Sheets

V-ENGINE AIR INTAKE STRUCTURE

CROSS-REFERENCE TO RELATED APPLICATIONS

This application is based upon and claims the benefit of priority of the prior Japanese Patent Application No. 2018-184408, filed on Sep. 28, 2018, the entire contents of which are incorporated herein by reference.

BACKGROUND OF THE INVENTION

Field of the Invention

The present invention relates to an air intake structure, especially of a V-engine, mounted on a vehicle such as a motorcycle.

Description of the Related Art

Conventionally, there has been a technique to mount actuators for driving throttle valve on respective front cylinder and rear cylinder of a V-engine to make electronically controlled throttles independent.

For example, in a vehicular power unit disclosed in Patent Document 1, both throttle bodies are individually equipped with electric actuators to rotationally drive valve shafts on which throttle valves are secured to control an intake air amount. The electric actuator is formed of an electric motor having a rotation shaft line parallel to the valve shaft on which the throttle valve is secured and a speed reducer disposed between this electric motor and the valve shaft.

Patent Document 1: Japanese Laid-open Patent Publication No. 2009-275514

However, in the related art, a throttle valve rotation shaft is parallel to a crankshaft. Thus, a length in a width direction of the electric actuator directly compresses a space in the width direction inside a vehicle body frame above an engine. Therefore, it makes substantially difficult to dispose an electronic component such as an ignition coil inside the vehicle body frame of this part, that is, an arrangement of other components, devices, and the like near the throttle body is compelled to be subject to constraints. There is also a problem that, for example, an actuator cover housing the electric actuator projects outside the throttle body in a vehicle side view to make it difficult to ensure a capacity of an air cleaner or a fuel tank close to the throttle body.

Further, in independent electronically controlled throttles of another conventional V-engine, throttle valve rotation shafts are arranged perpendicular to a crankshaft. In this case, actuators will be arranged any of above and below. When the actuators are arranged below, to establish a layout where the actuators are opposed to one another in the V-engine, it is necessary to divert an intake passage to separate throttle bodies one another in a front-rear direction. Meanwhile, when the actuators are arranged above, this affects the ensuring of capacities of an air cleaner and a fuel tank.

SUMMARY OF THE INVENTION

The present invention has been made in consideration of such circumstances, and the object is to ensure compactification and eliminate an effect on a peripheral component layout and the like.

A V-engine air intake structure of the present invention includes a first cylinder and a second cylinder that are arranged mutually inclined or perpendicular when viewed in a crankshaft direction. The first cylinder has a first throttle body mounted on a cylinder side surface on a side opposed to the second cylinder, and the second cylinder has a second throttle body mounted on a cylinder side surface on aside opposed to the first cylinder. The first throttle body and the second throttle body include valve rotation devices that independently drive respective throttle valves. The first throttle body and the second throttle body are arranged such that the respective valve rotation devices have states rotated around bore central axes to cause respective throttle valve rotation shafts to have angles with respect to straight lines parallel to a crankshaft in an engine top view.

DETAILED DESCRIPTION OF THE PREFERRED EMBODIMENTS

A V-engine air intake structure according to one embodiment of the present invention includes a first cylinder and a second cylinder that are arranged mutually inclined or perpendicular when viewed in a crankshaft direction. The first cylinder has a first throttle body mounted on a cylinder side surface on a side opposed to the second cylinder, and the second cylinder has a second throttle body mounted on a cylinder side surface on a side opposed to the first cylinder. The first throttle body and the second throttle body include valve rotation devices that independently drive respective throttle valves. The first throttle body and the second throttle body are arranged such that: the respective valve rotation devices have states rotated around bore central axes to cause respective throttle valve rotation shafts to have angles with respect to straight lines parallel to a crankshaft in an engine top view.

This brings the valve rotation devices inside in a vehicle-width direction. This decreases a width in a right-left direction of the periphery of the throttle bodies, thus ensuring compactification.

Embodiments

The following describes preferred embodiments of the present invention with reference to the attached drawings.

Figure 1:
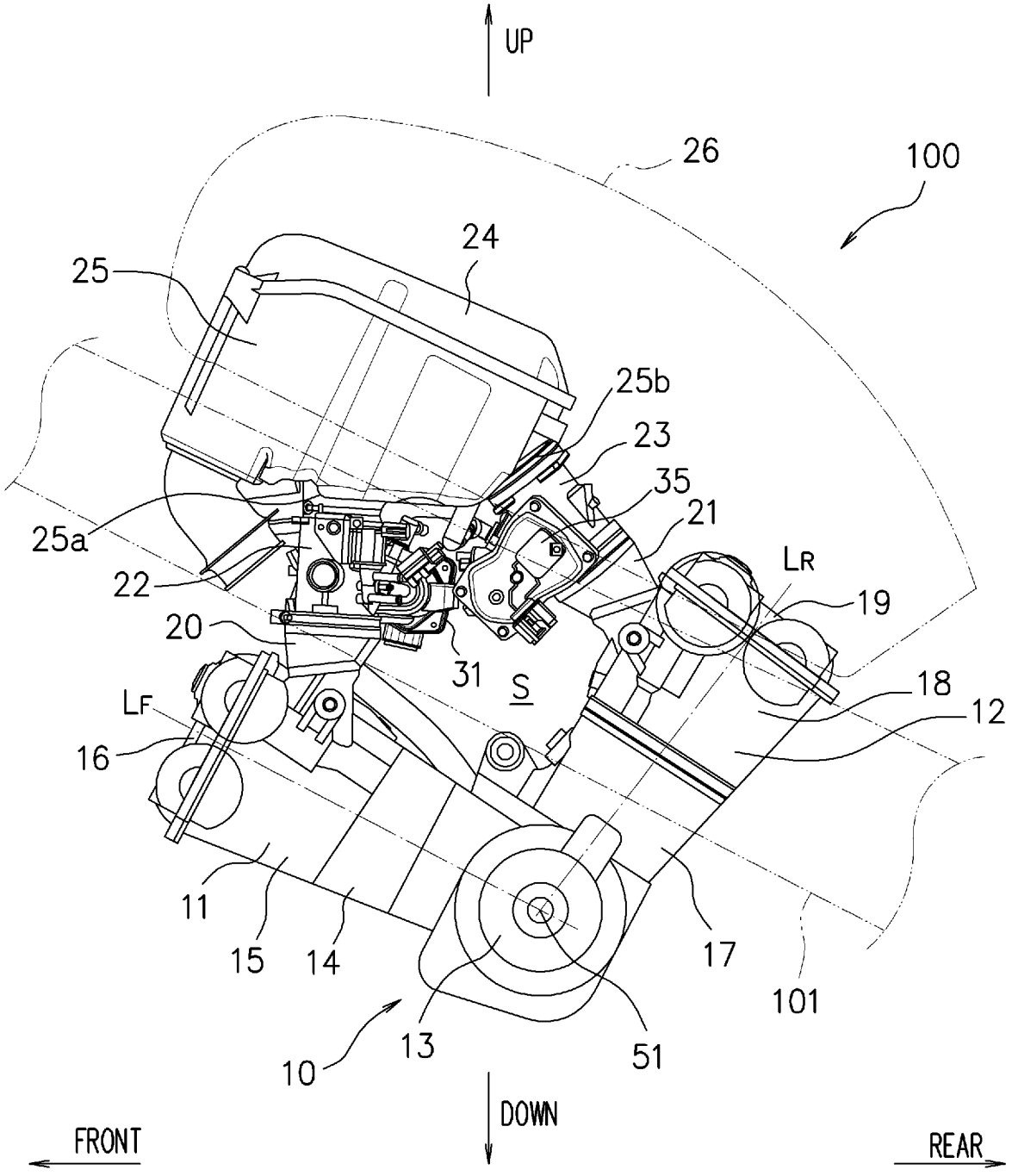
FIG. 1 is a side view of an engine unit of a motorcycle according to an embodiment of the present invention.

In this embodiment, a description will be given taking a multicylinder engine mounted on a motorcycle as an example. FIG. 1 is a side view of a periphery of an engine unit 10 of a motorcycle 100 when viewed from a right side. In this application, directions such as up and down, right and left, and front and rear mean directions in a state getting on the motorcycle 100 and indicate directions in the respective drawings.

The motorcycle 100 includes a vehicle body frame 101 such as a twin-spar frame. A front wheel and a rear wheel are arranged ahead and behind the vehicle body frame 101. The engine unit 10 is mounted on the vehicle body frame 101 near an approximately center portion of a vehicle. In this embodiment, the engine unit 10 is configured as, for example, a four-cycle multicylinder, typically, what is called a V-twin engine where a front cylinder 11 and a rear cylinder 12 are arranged in a V shape. The V shape means that the front cylinder 11 (a first cylinder) and the rear cylinder 12 (a second cylinder) are arranged mutually inclined or perpendicular when viewed in a crankshaft direction.

In the front cylinder 11, in an order from a crankcase 13 along a cylinder axis line $L_F$, a cylinder block 14, a cylinder head 15, and a cylinder head cover 16 are integratedly coupled (they are simply referred to as a cylinder). They constitute one cylinder. In the rear cylinder 12, in an order from the crankcase 13 along a cylinder axis line $L_R$, a cylinder block 17, a cylinder head 18, and a cylinder head cover 19 are integratedly coupled (they are simply referred to as a cylinder). They constitute one cylinder.

In this example, the front cylinder 11 is arranged in a form appropriately inclined forward, and the rear cylinder 12 is arranged in a form appropriately inclined rearward.

In a space S formed between the front and rear cylinders arranged in the V shape as described above, an intake air pipe 20 of the front cylinder 11 and an intake air pipe 21 of the rear cylinder 12 are respectively coupled with the cylinder head 15 and the cylinder head 18 with their openings oriented approximately upward. The intake air pipe 20 and the intake air pipe 21 are coupled with throttle bodies 22 and 23 respectively. The throttle bodies 22 and 23 are each coupled to an air cleaner 24. The air cleaner 24 is positioned approximately ahead and obliquely above the space S and has a deformed-box-shaped air cleaner box 25 projecting upward from between the right and left vehicle body frames 101. The throttle body 22 (a first throttle body) is coupled to a bottom surface portion 25*a* of the air cleaner box 25 to cause a clean air to be supplied from the air cleaner 24. The throttle body 23 (a second throttle body) is coupled to a rear side surface portion 25*b* of the air cleaner box 25 to cause a clean air to be supplied from the air cleaner 24.

As further illustrated in FIG. 1, a fuel tank 26 is arranged as being fitted to between the right and left vehicle body frame 101 in a vehicle-width direction as covering the air cleaner box 25 and the cylinder head cover 19 of the rear cylinder 12 from above. The fuel tank 26 is formed having, for example, an egg shape as in FIG. 1.

Figure 2:
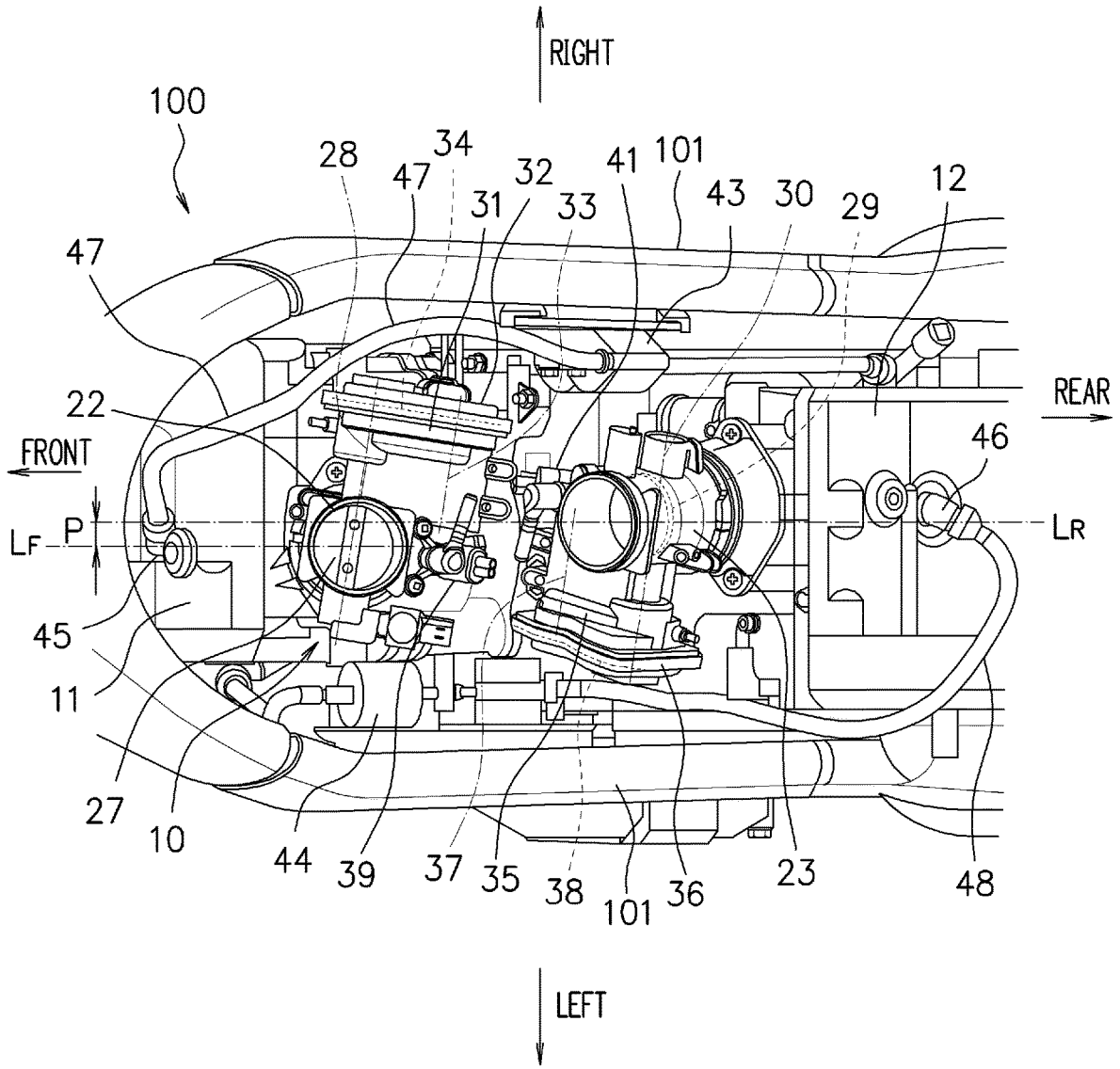
FIG. 2 is a top view illustrating a periphery of throttle bodies of a front cylinder and a rear cylinder according to the embodiment of the present invention.
Figure 3:
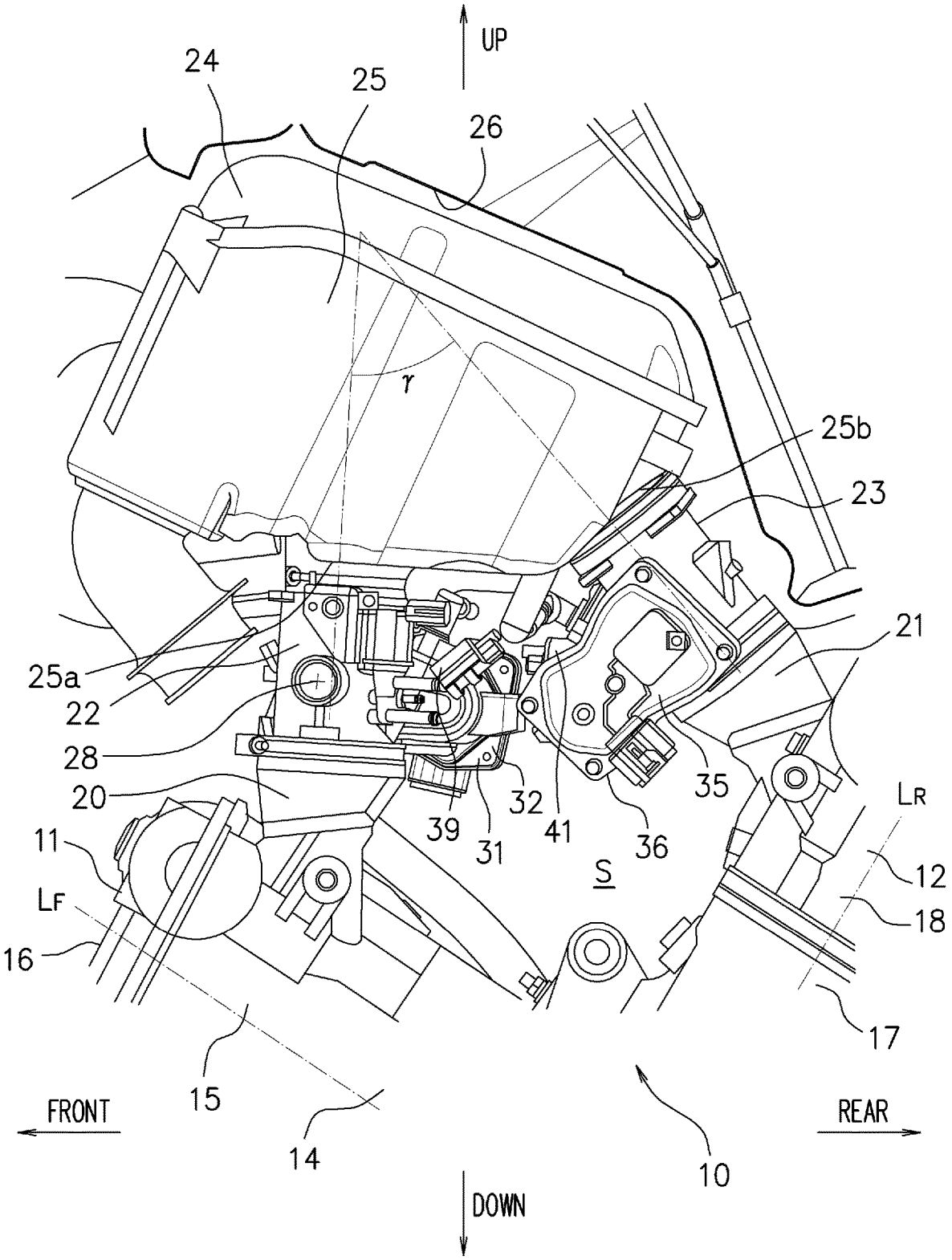
FIG. 3 is a left side view illustrating the periphery of the throttle bodies of the front cylinder and the rear cylinder according to the embodiment of the present invention.

FIG. 2 and FIG. 3 are a top view and a left side view illustrating a periphery of the throttle bodies 22 and 23 of the front cylinder 11 and the rear cylinder 12. The throttle body 22 is mounted on a side surface of the front cylinder 11 (specifically, the cylinder head 15) on a side opposed to the rear cylinder 12 via the intake air pipe 20 and arranged in an approximately vertical direction as in FIG. 3. The throttle body 23 is mounted on a side surface of the rear cylinder 12 (specifically, the cylinder head 18) on a side opposed to the front cylinder 11 via the intake air pipe 21 and arranged in a form appropriately inclined forward as in FIG. 3. As illustrated in FIG. 3, the throttle bodies 22 and 23 are arranged such that an angle γ formed by a central axis of the throttle body 22 and a central axis of the throttle body 23 in a side view is an acute angle ($\gamma<45°$).

As in FIG. 2, the throttle body 22 includes a throttle valve 27 that opens and closes an intake passage formed inside the throttle body 22. This throttle valve 27 is supported rotatably around a throttle valve rotation shaft 28.

The throttle body 23 includes a throttle valve 29 that opens and closes an intake passage formed inside the throttle body 23. This throttle valve 29 is supported rotatably around a throttle valve rotation shaft 30.

The throttle body 22 is equipped with a valve rotation device 31 for rotating the throttle valve 27. This valve rotation device 31 is configured including an actuator 33 (specifically, configured from an electric motor and briefly illustrated with its rotation shaft in FIG. 2) and a gear 34 (specifically, configured from a spur gear or the like and briefly illustrated with a dotted line in FIG. 2), which mutually couples the throttle valve rotation shaft 28 to the actuator 33, in a casing 32. In this example, the valve rotation device 31 is arranged on a right side as one side of the throttle body 22.

The actuator 33 is rotatably driven, based on an accelerator operation of the motorcycle 100, with a drive signal from an Engine Control Unit corresponding to this accelerator operation. This rotates the throttle valve rotation shaft 28 via the gear 34.

The throttle body 23 is equipped with a valve rotation device 35 for rotating the throttle valve 29. This valve rotation device 35 is configured including an actuator 37 (specifically, configured from an electric motor and briefly illustrated with its rotation shaft in FIG. 2) and a gear 38 (specifically, configured from a spur gear or the like and briefly illustrated with a dotted line in FIG. 2), which mutually couples the throttle valve rotation shaft 30 to the actuator 37, in a casing 36. In this example, the valve rotation device 35 is arranged on a left side as another side of the throttle body 23.

The actuator 37 is rotatably driven, based on the accelerator operation of the motorcycle 100, with the drive signal from the Engine Control Unit corresponding to this accelerator operation. This rotates the throttle valve rotation shaft 30 via the gear 38.

Figure 4:
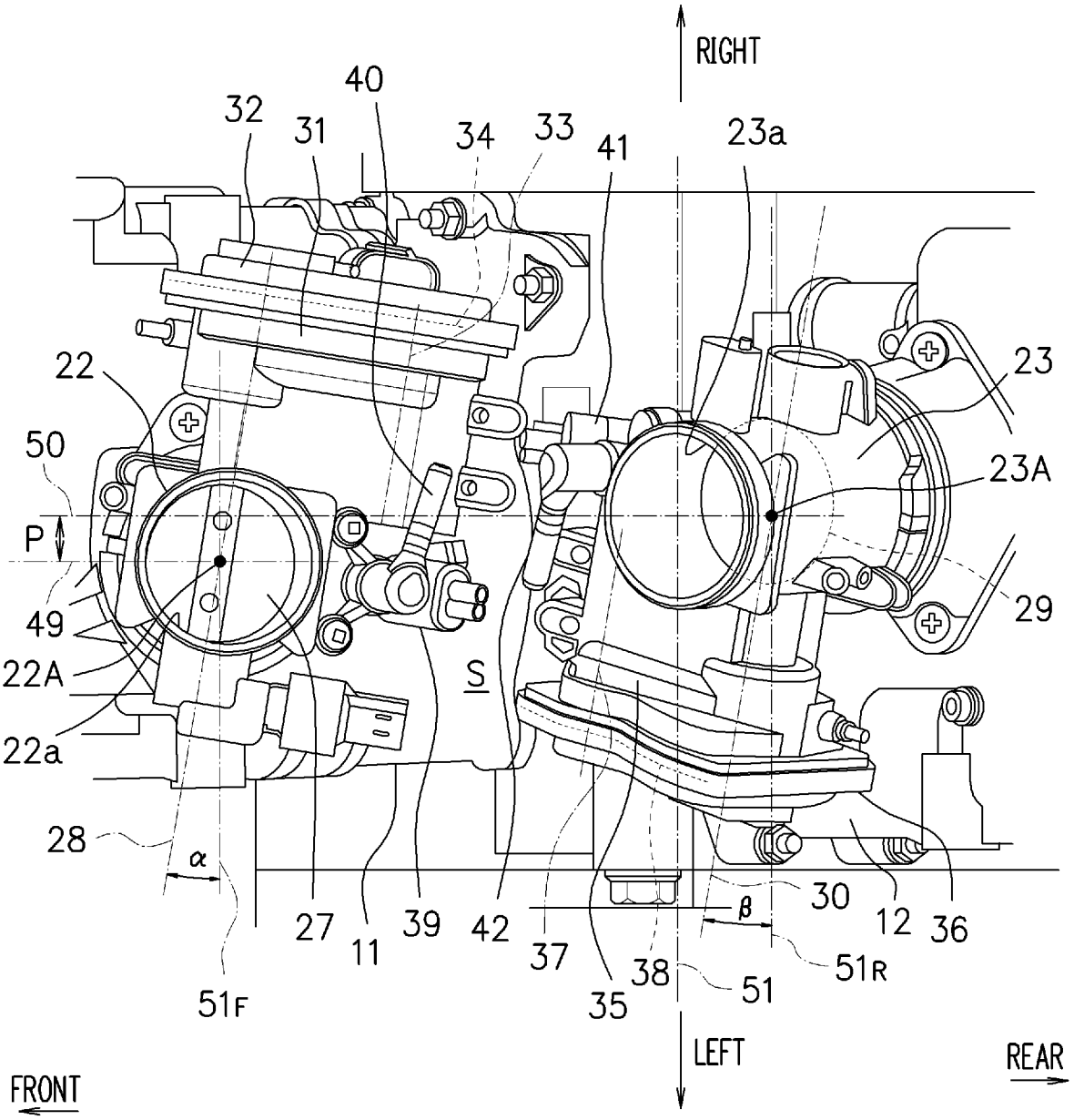
FIG. 4 is an enlarged top view illustrating the periphery of the throttle bodies of the front cylinder and the rear cylinder according to the embodiment of the present invention.
Figure 5:
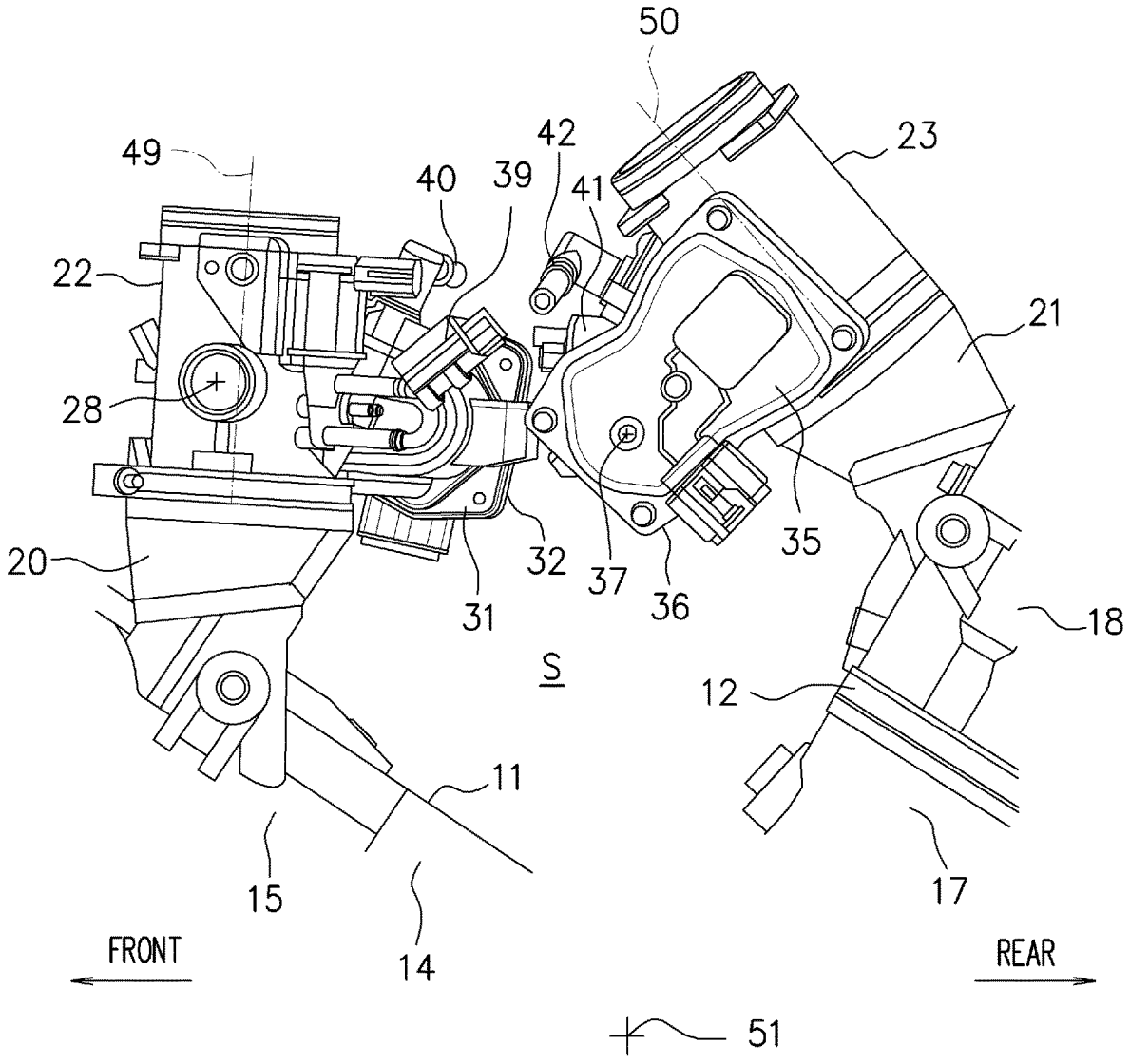
FIG. 5 is an enlarged left side view illustrating the periphery of the throttle bodies of the front cylinder and the rear cylinder according to the embodiment of the present invention.

FIG. 4 and FIG. 5 are an enlarged top view and an enlarged left side view illustrating the periphery of the throttle bodies 22 and 23 of the front cylinder 11 and the rear cylinder 12. An injector 39 is mounted on a rear side surface of the throttle body 22 of the front cylinder 11, that is, a side of the rear cylinder 12, with being oriented to the intake air pipe 20, thus injecting a fuel into an intake passage formed inside the intake air pipe 20. A fuel joint 40 is incidentally mounted on an upper side of the injector 39. A fuel pipe coupled to the fuel tank 26 to feed the fuel is coupled to the fuel joint 40. The injector 39 is controlled by the Engine Control Unit to inject the fuel supplied via the fuel joint 40 into the intake passage at a predetermined timing.

An injector 41 is mounted on a front side surface of the throttle body 23 of the rear cylinder 12, that is, a side of the front cylinder 11, with being oriented to the intake air pipe 21, thus injecting a fuel into an intake passage formed inside the intake air pipe 21. A fuel joint 42 is incidentally mounted on an upper side of the injector 41. A fuel pipe is coupled to the fuel joint 42 similarly to the fuel joint 40. The injector 41 is controlled by the Engine Control Unit to inject the fuel supplied via the fuel joint 42 into the intake passage at a predetermined timing.

Here, with reference to FIG. 2, between the vehicle body frame 101, and the front cylinder 11 and the rear cylinder 12 inside the vehicle body frame 101, ignition coils 43 and 44 are arranged, and ignition codes 47 and 48 are routed to couple these ignition coils 43 and 44 to spark plugs 45 and 46.

As illustrated in FIG. 4, the throttle body 22 includes a bore 22*a* forming the internal intake passage. A bore central axis 49 passing through the center of the bore 22*a* is extending in a longitudinal direction of the throttle body 22 as in FIG. 5. Similarly, as illustrated in FIG. 4, the throttle body 23 includes a bore 23*a* forming the internal intake passage. A bore central axis 50 passing through the center of the bore 23*a* is extending in a longitudinal direction of the throttle body 23 as in FIG. 5. An intersection point of the bore central axis 49 and the throttle valve rotation shaft 28 is defined as a throttle valve center point 22A. An intersection point of the bore central axis 50 and the throttle valve rotation shaft 30 is defined as a throttle valve center point 23A.

Here, as illustrated in FIG. 4 and FIG. 5, a crankshaft 51 common to the front cylinder 11 and the rear cylinder 12 is disposed to extend in a right-left direction. In FIG. 4, the throttle valve rotation shaft 28 is arranged passing through the throttle valve center point 22A of the bore 22*a* to cause the valve rotation device 31 to have a state rotated around the bore central axis 49 to have an angle $\alpha$ with a straight line $\mathbf{51}_F$ parallel to the crankshaft 51.

The throttle valve rotation shaft 30 is arranged passing through the throttle valve center point 23A of the bore 23*a* to cause the valve rotation device 35 to have a state rotated around the bore central axis 50 to have an angle $\beta$ with a straight line $\mathbf{51}_R$ parallel to the crankshaft 51.

The rotation angle of the valve rotation device 31 and the rotation angle of the valve rotation device 35 may be equal, or an appropriate magnitude relationship is settable as necessary.

In the above-described case, the valve rotation device 31 is arranged as being biased to a side close to the crankshaft 51 with respect to the straight line $\mathbf{51}_F$. The valve rotation device 35 is arranged as being biased to a side close to the crankshaft 51 with respect to the straight line $\mathbf{51}_R$. Both of the valve rotation device 31 and the valve rotation device 35 are arranged as entering into the space S between the front cylinder 11 and the rear cylinder 12.

Engine configurations of the front cylinder 11 and the rear cylinder 12 themselves are substantially identical, and the front cylinder 11 and the rear cylinder 12 are arranged in the V shape with left-right reversal relationship. In this case, as illustrated in FIG. 2, the cylinder axis line $L_R$ of the rear cylinder 12 is shifted to one side (in this embodiment, the right side) with respect to the cylinder axis line $L_F$ of the front cylinder 11, and thus, a shifting amount P is set. The bore central axis 49 of the throttle body 22 conforms to an identical straight line with respect to the cylinder axis line $L_F$ of the front cylinder 11 when viewed in a front-rear direction. The bore central axis 50 of the throttle body 23 conforms to an identical straight line with respect to the cylinder axis line $L_R$ of the rear cylinder 12 when viewed in the front-rear direction. Therefore, corresponding to the shifting of the cylinder axis line $L_R$ from the cylinder axis line $L_F$, the bore central axis 50 of the throttle body 23 is shifted from the bore central axis 49 of the throttle body 22 with the shifting amount P as in FIG. 4.

In the above-described case, as illustrated in FIG. 4 and FIG. 5, in the front cylinder 11, the actuator 33 and the injector 39 are arranged on an identical side (the space S as the rear side) with respect to the bore central axis 49 of the throttle body 22. In the rear cylinder 12, the actuator 37 and the injector 41 are arranged on an identical side (the space S as the front side) with respect to the bore central axis 50 of the throttle body 23.

The fuel joint 40 of the injector 39 and the fuel joint 42 of the injector 41, to both of which the fuel is supplied from a fuel delivery pipe, are arranged as being opposed to one another as in FIG. 4.

Further, as illustrated in FIG. 2, inside the vehicle body frame 101, the actuator 33 of the front cylinder 11 and the ignition coil 44 are arranged on opposite sides in the right-left direction. The actuator 37 of the rear cylinder 12 and the ignition coil 43 are arranged on opposite sides in the right-left direction.

In the V-engine air intake structure of the present invention, the throttle valve rotation shaft 28 and the throttle valve rotation shaft 30 both are arranged to have a state rotated with respect to the direction of the crankshaft 51, that is, inclined with respect to the right-left direction. The valve rotation device 31 and the valve rotation device 35, which are projecting laterally from the throttle bodies 22 and 23 when the throttle valve rotation shaft 28 and the throttle valve rotation shaft 30 remain parallel to the crankshaft 51, are brought inside in the vehicle-width direction. This decreases a width in the right-left direction of the periphery of the throttle bodies 22 and 23, thus ensuring the compactification.

In this case, the valve rotation device 31 and the valve rotation device 35 are arranged as being biased to the sides close to the crankshaft 51, and both are arranged as entering into the space S between the front cylinder 11 and the rear cylinder 12.

Thus, the valve rotation device 31 and the valve rotation device 35 are moved inside the space S of a V bank. This reduces the projection of the valve rotation device 31 and the valve rotation device 35 to eliminate a positional constraint with respect to the air cleaner 24 and the fuel tank 26, which are positioned above the engine unit 10, that is, eliminate an effect on peripheral components and the like, thus facilitating ensuring of their capacities.

The valve rotation device 31 is arranged on one side of the throttle body 22 and the valve rotation device 35 is arranged on another side of the throttle body 23 respectively.

Arranging the valve rotation device 31 and the valve rotation device 35 in an opposite positional relationship in the right-left direction can effectively utilize the space S of the V bank such that they do not interfere with one another.

In this case, shifting the cylinder axis line $L_R$ of the rear cylinder 12 from the cylinder axis line $L_F$ of the front cylinder 11 contributes to the effective utilization of the space S more effectively.

The actuator 33 and the injector 39 of the front cylinder 11 are arranged on the identical side, and the actuator 37 and the injector 41 of the rear cylinder 12 are arranged on the identical side. This facilitates the ensuring of capacities of the air cleaner 24 and the fuel tank 26.

Making the fuel joint 40 of the injector 39 and the fuel joint 42 of the injector 41 be opposed to one another ensures common usage of the throttle bodies 22 and 23, thus realizing cost reduction.

Further, the positional relationship in the right-left direction between the actuator 33 of the front cylinder 11 and the ignition coil 44 and the positional relationship in the right-left direction between the actuator 37 of the rear cylinder 12 and the ignition coil 43 ensure the arrangement with a well-balanced weight in the right-left direction.

While the embodiments of the present invention are described in detail with reference to the drawings, the respective embodiments merely describe the concrete examples to embody the present invention. The technical scope of the present invention is not limited to the respective embodiments. The present invention can be variously modified within the scope of not departing from the gist and the modifications are included in the technical scope of the present invention.

The configuration of the present invention can be configured in the left-right reversal relationship.

With the present invention, the compactification is ensured and the effect on the peripheral component layout and the like can be eliminated.

What is claimed is:

1. A V-engine air intake structure comprising a first cylinder and a second cylinder that are arranged mutually inclined or perpendicular when viewed in a crankshaft direction, wherein the first cylinder has a first throttle body mounted on a cylinder side surface on a side opposed to the second cylinder, and the second cylinder has a second throttle body mounted on a cylinder side surface on a side opposed to the first cylinder, the first throttle body includes a first valve rotation device that drives a first throttle valve, and the second throttle body includes a second valve rotation device that drives a second throttle valve independently of the first valve rotation device, and the first throttle body and the second throttle body are arranged such that the first and second valve rotation devices have states rotated around bore central axes to cause respective throttle valve rotation shafts forming angles with respect to reference lines, wherein the reference lines are parallel to a crankshaft in an engine top view, wherein the second cylinder has a cylinder axis line shifted to one side with respect to a cylinder axis line of the first cylinder.

2. The V-engine air intake structure according to claim 1, wherein the first throttle body and the second throttle body are arranged such that the valve rotation devices are biased to sides of the crankshaft in the engine top view.

3. The V-engine air intake structure according to claim 1, wherein the first valve rotation device is disposed on one side in the crankshaft direction with respect to the bore central axis of the first valve rotation device, and the second valve rotation device is disposed on another side in the crankshaft direction with respect to the bore central axis of the second valve rotation device.

4. The V-engine air intake structure according to claim 2, wherein the first valve rotation device is disposed on one side in the crankshaft direction with respect to the bore central axis of the first valve rotation device, and the second valve rotation device is disposed on another side in the crankshaft direction with respect to the bore central axis of the second valve rotation device.

5. The V-engine air intake structure according to claim 2, wherein a first injector is mounted on a surface of the first throttle body near the second cylinder, and the second injector is mounted on a surface of the second throttle body near the first cylinder in the engine side view, in the first cylinder, the first valve rotation device and the first injector are arranged on an identical side with respect to the bore central axes of the first throttle body, and in the second cylinder, the second valve rotation device and the second injector are arranged on an identical side with respect to the bore central axes of the second throttle body.

6. The V-engine air intake structure according to claim 5, wherein a first fuel joint is mounted on an upper side of the first injector, and a second fuel joint is mounted on an upper side of the second injector, a first fuel pipe is coupled to the first fuel joint, and a second fuel pipe is coupled to the second fuel joint, the first fuel joint and the second fuel joint are arranged as being opposed to one another.

7. The V-engine air intake structure according to claim 3, wherein the first valve rotation device includes a first actuator configured from an electric motor, and the second valve rotation device includes a second actuator configured from an electric motor, the first actuator is arranged on one side of the first throttle body, and the second actuator is arranged on the other side of the second throttle body, one of ignition coils is arranged on an opposite side in a left-right direction of the first actuator with the first throttle body in between, and the other one of the ignition coils is arranged on an opposite side in a left-right direction of the second actuator with the second throttle body in between.

* * * * *